US005791091A

United States Patent [19]

Barbera

[11] Patent Number: 5,791,091

[45] Date of Patent: Aug. 11, 1998

[54] GUTTER SYSTEM COMPRISED OF TUBULAR ELEMENTS CONNECTED BY TUBULAR CONNECTING ELEMENTS

[76] Inventor: Salvatore J. Barbera, 358 Falmouth Ave., Elmwood Park, N.J. 07407

[21] Appl. No.: 888,349

[22] Filed: Jul. 3, 1997

[51] Int. Cl.[6] ..... E04D 13/04

[52] U.S. Cl. ..... 52/12; 52/11

[58] Field of Search ..... 52/11, 12, 16, 52/60

[56] References Cited

U.S. PATENT DOCUMENTS

| | | | |
|---|---|---|---|
| 2,120,395 | 6/1938 | Dean . | |
| 3,357,143 | 12/1967 | Bayes et al. . | |
| 3,884,753 | 5/1975 | Nalle, Jr. . | |
| 4,551,956 | 11/1985 | Axford . | |
| 4,571,896 | 2/1986 | Condie | 52/12 |
| 4,858,396 | 8/1989 | Rose et al. . | |
| 4,905,427 | 3/1990 | McPhalen . | |
| 5,095,666 | 3/1992 | Williams, Jr. . | |
| 5,332,332 | 7/1994 | Kenyon, Jr. . | |
| 5,437,138 | 8/1995 | Tuohey et al. . | |
| 5,497,583 | 3/1996 | Rhoads . | |

FOREIGN PATENT DOCUMENTS 1509127 8/1969 Germany .

*Primary Examiner*—Carl D. Friedman
*Assistant Examiner*—Yvonne Horton-Richardson
*Attorney, Agent, or Firm*—Richard M. Goldberg

[57] ABSTRACT

A gutter system includes a plurality of main tubular members and tubular connecting members; each main tubular member including a first PVC tube with no lengthwise slit therein, a first hanging panel with holes therein, a first run off preventing panel formed to an opposite side thereof, a first holes in the tube between the hanging and run off preventing panels, and each tubular connecting member including a second PVC tube of greater diameter than said first tubes, the second tube having a much shorter length, the second tube having outwardly bowed U-shaped circumferential adhesive receiving channels at opposite ends, a second hanging panel having holes, a second run off preventing panel formed to an opposite side of the second tube, second holes in the second tube between the second hanging and second run off preventing panels, a first slit at opposite ends of the second tube and extending for a distance less than one-half the length of the second tube to receive a first hanging panel, and a second slit at opposite ends of the second tube and on an opposite side of the second tube from the first slit, the second slit extending for a distance less than one-half the length of the second tube to receive the first run off preventing panel, and at least one tubular connecting member includes a downspout connection for connecting to a downspout.

22 Claims, 6 Drawing Sheets

GUTTER SYSTEM COMPRISED OF TUBULAR ELEMENTS CONNECTED BY TUBULAR CONNECTING ELEMENTS

BACKGROUND OF THE INVENTION

This invention relates generally to gutter systems, and more particularly, is directed to a gutter system comprised of tubular elements connected by tubular connecting elements.

Conventionally, gutter systems have been secured to the outer peripheries of buildings to catch rain and guide the rain to a particular location at ground level, through a downspout. Such gutter systems have a generally U-shaped cross-section so as to form a trough for catching and guiding the rain.

However, gutter systems of this type are generally formed of extruded or shaped metal pieces, and are therefore expensive and costly to manufacture. Because they are U-shaped, such gutter systems are also relatively weak, that is, lack structural integrity. Further, such gutter systems are open at the upper ends thereof, so that leaves and other large debris which fall therein, are difficult to remove, and more importantly, clog up the gutters so as to prevent or impede the flow of rain therein. Guards are known which secure to the upper ends of the gutters to prevent leaves from falling therein. However, such guards add to the cost and labor of the gutter system. See, for example, U.S. Pat. No. 4,905,427 To McPhalen, U.S. Pat. No. 5,095,666 to Williams, Jr. and German Offenlegungsschrift No. 1,509,127.

Although U-shaped gutter systems are known which are made from polyvinylchloride (PVC) pipe, such gutter systems must be cut lengthwise, and are also difficult and costly to manufacture. See, for example, U.S. Pat. No. 5,437,138 to Tuohey et al.

Other gutter systems are known in which a substantially pipe-like structure is provided having a single lengthwise slit at the upper surface along all or substantially all of the length thereof. See, for example, U.S. Pat. No. 2,120,395 to Dean, U.S. Pat. No. 3,884,753 to Nalle, Jr., U.S. Pat. No. 4,858,396 to Rose et al, U.S. Pat. No. 5,332,332 to Kenyon, Jr. and U.S. Pat. No. 5,497,583 to Rhoads. However, such lengthwise slits reduce the structural integrity of the system, thereby weakening the strength of the gutters. Further, if the gutter system is made of sheet metal of the like, as in U.S. Pat. No. 2,120,395 to Dean, the sections can telescope within each other and then be soldered. However, this is not available when using a relatively rigid pipe, such as PVC. In such case, it is known that PVC pipe is constructed with a slightly flared end. Thus, if the adjacent PVC pipe is cut so as not to have the flared end, such non-flared cut end can fit within the flared end of the other PVC pipe. However, such fit between the pipes is subject to misalignment and gaps, and is difficult to seal.

Although use of PVC pipe without such lengthwise slits is known, for example, from U.S. Pat. No. 4,551,956 to Axford, this gutter system is very different, in that it supports the PVC pipe within a conventional U-shaped gutter, thereby greatly increasing the cost and complexity of manufacture and assembly.

OBJECTS AND SUMMARY OF THE INVENTION

Accordingly, it is an object of the present invention to provide a gutter system that overcomes the problems with the aforementioned prior art.

It is another object of the present invention to provide a gutter system that uses PVC pipe alone, without any lengthwise slit therein that would otherwise tend to weaken the structural integrity of the same.

It is still another object of the present invention to provide a gutter system having a novel tubular connecting member that connects together adjacent PVC pipes of the gutter system.

It is yet another object of the present invention to provide a gutter system in which the tubular connecting member has its ends bowed outwardly around the circumference thereof to receive an adhesive to secure the connector to the elongated PVC pipe after assembly thereof.

It is a further object of the present invention to provide a gutter system in which the tubular connecting member has two partial axially oriented slits at opposite ends thereof which receive the hanging panel and run off prevention panels of the main tubular members.

It is a still further object of the present invention to provide a gutter system that prevents leaves and large debris from entering into the PVC pipe.

It is a yet further object of the present invention to provide a gutter system that can use conventionally formed PVC tubes.

It is a another object of the present invention to provide a gutter system that can be formed of PVC tubular elements in various shapes and sizes.

It is still another object of the present invention to provide entire gutter system that can be entirely assembled before adhesively securing the same together.

It is yet another object of the present invention to provide a gutter system that is easy and economical to assemble and manufacture.

In accordance with an aspect of the present invention, a gutter system includes a plurality of main tubular members and tubular connecting members. Each main tubular member includes a first tube extending in an axial direction, a first hanging panel extending substantially the entire length of the tube and formed to one side of the tube, for securing the tube to a building, and a first run off preventing panel extending substantially the entire length of the tube and formed to an opposite side of the tube, for preventing run off of water from the tube. A plurality of first spaced apart holes are provided in the tube in an area between the hanging panel and the run off preventing panel, such that the tube is substantially continuously unbroken except for the holes. Each tubular connecting member includes a second tube having ends with an inner diameter equal to or greater than an outer diameter of ends of the first tubes of the main tubular members so as to receive the ends of the first tubes therein, the second tube extending in the axial direction and having a length much less than the lengths of the main tubular members. A second hanging panel extends in the axial direction and is formed to one side of the second tube, for securing the second tube to the building, and a second run off preventing panel extends in the axial direction and is formed to an opposite side of the second tube, for preventing run off of water from the second tube. There are a plurality of second spaced apart holes in the second tube in an area between the second hanging panel and the second run off preventing panel. A first slit extends in the axial direction from opposite ends of the second tube and extends for a distance less than one-half the length of the second tube so as to define a central portion of the second tube which is not cut-away. Each first slit is adapted to receive the first hanging panel when the tubular connecting member is inserted over an end of a main tubular member. A second slit extends in the axial direction from opposite ends of the second tube and on an opposite side of the second tube from the first slit, the second slit extending for a distance less than one-half the length of the second tube so as to define a central portion of the second tube which is not cut-away. Each second slit is adapted to receive the first run off preventing panel when the tubular connecting member is inserted over an end of a main tubular member. Each hanging panel includes at least one hole therein for securing the main tubular members and tubular connecting members to a building.

Preferably, the first and second hanging panels are formed on the first tube and second tube, respectively, at angular positions on the first and second tubes of approximately 90° from an upper end thereof. Also, the first and second run off preventing panels are formed on the first tube and second tube, respectively, at angular positions on the first and second tubes of approximately 45° from an upper end thereof. The second hanging panel and the second run off preventing panel are formed on the central portion of the second tube, and extend in the axial direction for a length less than the length of the second tube.

The first tubes of the main tubular members and the second tubes of the tubular connecting members are made from PVC pipe.

Further, at least one said tubular connecting member includes a downspout connection for connecting to a downspout. There is also a second tubular connecting member for connecting the downspout connection to a downspout, the second tubular connecting member including a tube having ends with an inner diameter equal to or greater than an outer diameter of a free end of the downspout connection and the downspout so as to receive said ends of the downspout connection and the downspout therein, the tube of the second connecting member being deformed at opposite ends thereof with outwardly bowed U-shaped circumferential channels for receiving an adhesive therein to secure the second tubular connecting member to the downspout connection and to the downspout.

In accordance with another aspect of the present invention, a gutter system includes a plurality of main tubular members and tubular connecting members. Each main tubular member includes a first tube extending in an axial direction, a first hanging panel extending in the axial direction substantially the entire length of the tube and formed to one side of the tube, for securing the tube to a building, and a first run off preventing panel extending in the axial direction substantially the entire length of the tube and formed to an opposite side of the tube, for preventing run off of water from the tube. A plurality of first spaced apart holes are provided in the tube in an area between the hanging panel and the run off preventing panel. Each tubular connecting member includes a second tube having ends with an inner diameter equal to or greater than an outer diameter of ends of the first tubes of the main tubular members so as to receive the ends of the first tubes therein, the second tube extending in the axial direction and having a length much less than the lengths of the main tubular members. Further, the second tube is deformed at opposite ends thereof with outwardly bowed U-shaped circumferential channels for receiving an adhesive therein to secure the tubular connecting members to the main tubular members. A second hanging panel extends in the axial direction and is formed to one side of the second tube, for securing the second tube to the building. A second run off preventing panel extends in the axial direction and is formed to an opposite side of the second tube, for preventing run off of water from the second tube. A plurality of second spaced apart holes are provided in the second tube in an area between the second hanging panel and the second run off preventing panel. A first slit extends in the axial direction from opposite ends of the second tube and extends for a distance less than one-half the length of the second tube so as to define a central portion of the second tube which is not cut-away, each first slit adapted to receive the first hanging panel when the tubular connecting member is inserted over an end of a main tubular member. A second slit extends in the axial direction from opposite ends of the second tube and on an opposite side of the second tube from the first slit, the second slit extending for a distance less than one-half the length of the second tube so as to define a central portion of the second tube which is not cut-away, each second slit adapted to receive the first run off preventing panel when the tubular connecting member is inserted over an end of a main tubular member.

In accordance with still another aspect of the present invention, a gutter system includes a plurality of main tubular members and tubular connecting members. Each main tubular member includes a first PVC tube extending in an axial direction, a first hanging panel extending in the axial direction substantially the entire length of the tube and formed to one side of the tube, the hanging panel including at least one hole therein for securing the main tubular member to a building, and a first run off preventing panel extending in the axial direction substantially the entire length of the tube and formed to an opposite side of the tube, for preventing run off of water from the tube. A plurality of first spaced apart holes are provided in the tube in an area between the hanging panel and the run off preventing panel such that the tube is substantially continuously unbroken except for the first holes therein. Each tubular connecting member includes a second PVC tube having ends with an inner diameter equal to or greater than an outer diameter of ends of the first tubes of the main tubular members so as to receive the ends of the first tubes therein, the second tube extending in the axial direction and having a length much less than the lengths of the main tubular members. Further, the second tube is deformed at opposite ends thereof with outwardly bowed U-shaped circumferential channels for receiving an adhesive therein to secure the tubular connecting members to the main tubular members. A second hanging panel extends in the axial direction for a length less than the length of the second tube and is formed to one side of the second tube, the second hanging panel including at least one hole therein for securing the tubular connecting member to a building. A second run off preventing panel extends in the axial direction for a length less than the length of the second tube and is formed to an opposite side of the second tube, for preventing run off of water from the second tube. A plurality of second spaced apart holes are provided in the second tube in an area between the second hanging panel and the second run off preventing panel. A first slit extends in the axial direction from opposite ends of the second tube and extends for a distance less than one-half the length of the second tube so as to define a central portion of the second tube which is not cut-away, each first slit adapted to receive the first hanging panel when the tubular connecting member is inserted over an end of a main tubular member, and a second slit extending in the axial direction from opposite ends of the second tube and on an opposite side of the second tube from the first slit, the second slit extending for a distance less than one-half the length of the second tube so as to define a central portion of the second tube which is not cut-away, each second slit adapted to receive the first run off preventing panel when the tubular connecting member is inserted over an end of a main tubular member.

The above and other objects, features and advantages of the invention will become readily apparent from the following detailed description thereof which is to be read in connection with the accompanying drawings.

DETAILED DESCRIPTION OF THE PREFERRED EMBODIMENTS

Figure 1:
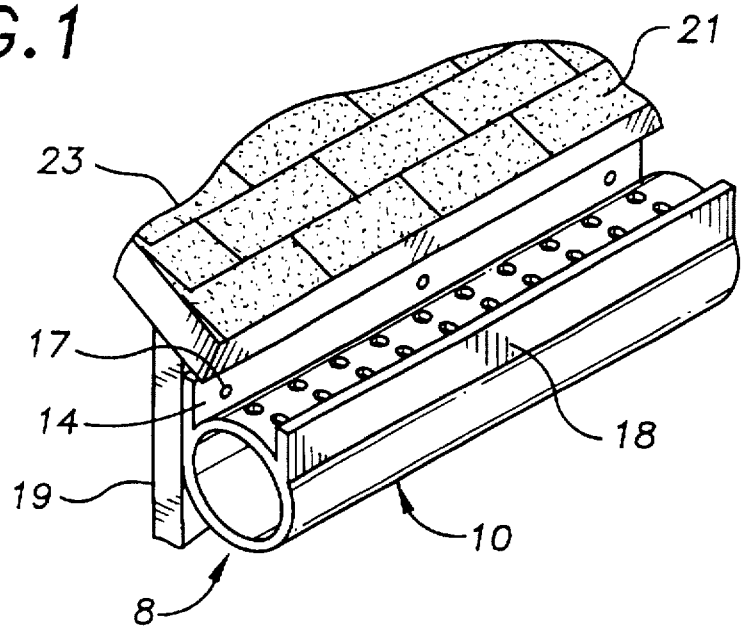
FIG. 1 is a perspective view of a portion of a building with the gutter system according to the present invention.

Referring to the drawings in detail, a gutter system 8 according to the present invention includes a plurality of elongated main tubular members 10 connected together by tubular connecting members 12. Each tubular member 10 is preferably a rigid member made of polyvinylchloride (PVC) pipe. In this regard, a preferred outer diameter of each main tubular member 10 is three inches, although any other suitable dimension can be used. The inner diameter of each tubular connecting member 12 is substantially equal to, or slightly greater than, the outer diameter of main tubular members 10 so that tubular connecting members 12 can telescopically receive the ends of main tubular members 10 therein. Alternatively, tubular connecting members 12 can have slightly flared ends, in order to receive main tubular members 10.

The lengths of main tubular members 10 and tubular connecting members 12 can vary, but preferably, main tubular member 10 has a length in the range of ten feet to thirty feet, and tubular connecting member 12 has a length of ten inches. Of course, main tubular members 10 can be cut to provide any other length.

Each main tubular member 10 includes a rectangular hanging panel 14 extending at an approximately mid-horizontal plane thereof, that is, 90° from top dead center TDC (0°) and formed integrally with tubular member 10 as a unitary member. Hanging panel 14 extends upwardly to a height above tubular member 10, and includes hanging holes 16 therein for receiving nails 17 in order to secure hanging panel 14, and thereby, tubular member 10, to the side 19 of a building, immediately below the eaves 21 of a roof 23. At the opposite side of tubular member 10, there is a rectangular run off preventing panel 18 extending at a position higher than that of hanging panel 14, for example, at an angle of α from top dead center and formed integrally with tubular member 10 as a unitary member. For example, panel 18 can be formed at a position approximately 45° from top dead center. Generally, panel 18 is shorter than panel 14, since panel 18 is only used to prevent run off of water, although the height of panel 18 can vary within the scope of this invention.

Figure 2:
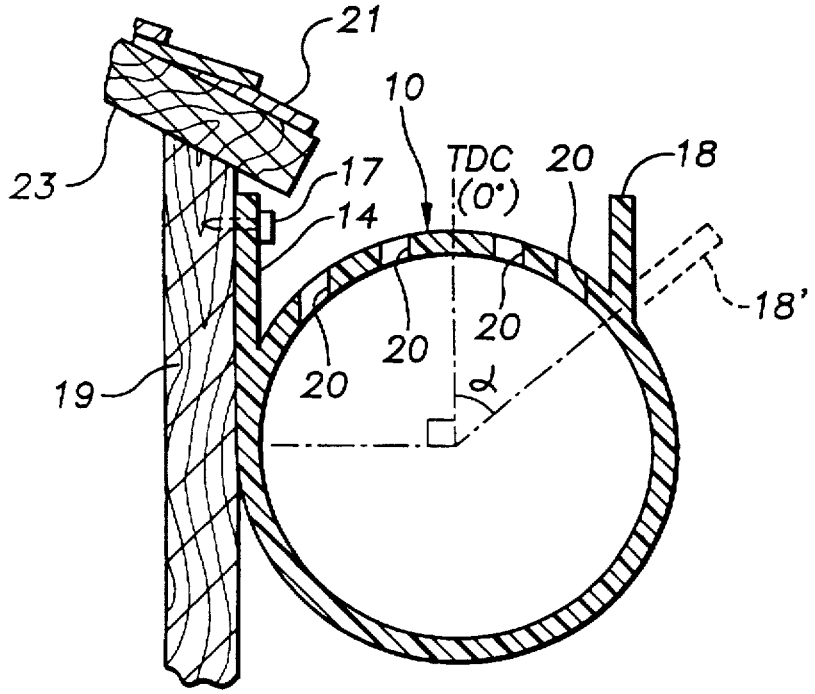
FIG. 2 is a transverse cross-sectional view of FIG. 1.
Figure 3:
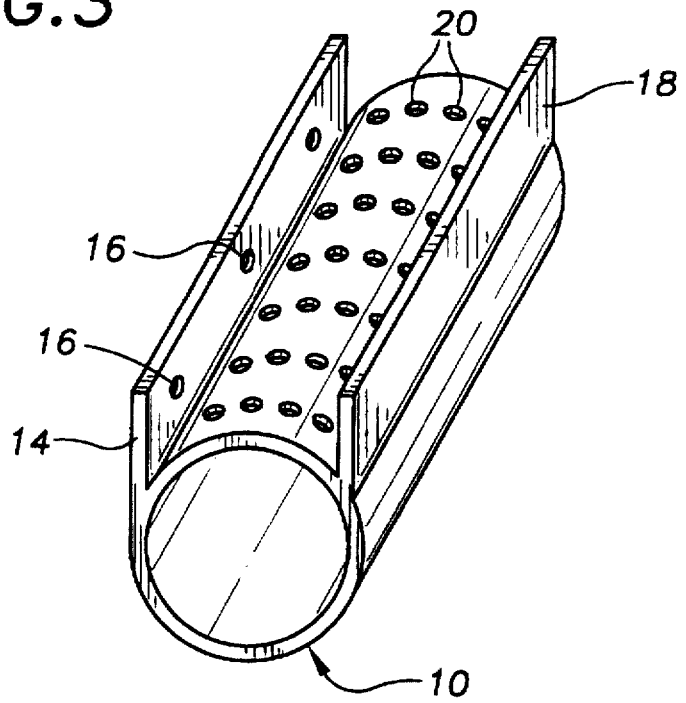
FIG. 3 is a perspective view of an elongated main tubular member of the gutter system.

Alternatively, in a more preferred arrangement, as shown by dashed lines in FIG. 2, panel 18' extends outwardly from tubular member 10 in a radial direction, but still a little higher than the upper end of tubular member 10. With this arrangement, leaves that fall on the top of tubular member 10 can be easily blown out or washed off. However, panel 18' still functions to prevent run off of water.

Further, a plurality of holes 20 are provided in the upper portion of tubular member 10 between panels 14 and 18. The number, size and spacing of holes 20 can vary within the scope of the present invention. It will be appreciated that, unlike the prior art, there are no lengthwise slits in main tubular member 10, but rather, main tubular member 10 presents a substantially continuous unbroken tube except for the spaced apart holes 20. Because of panels 14 and 18, any water impinging upon the upper surface of main tubular members 10 is prevented from escaping, and must enter holes 20, where the water is drained off to another location, for example, to a downspout.

As discussed above, each tubular connecting member 12 is much shorter than main tubular members 10, since it is only used for connection. Each tubular connecting member 12 is cut away from opposite ends thereof to form slits extending in the axial direction of connecting member 12. Specifically, there is a first slit **22*a* at each end which is oriented at approximately 90° from top dead center and is adapted to receive hanging panel 14 when connecting member 12 is telescoped over a main tubular member 10. A second slit 22*b* is provided at each end and to the side of connecting member 12 opposite to first slit 22*a*. Second slit 22*b* is oriented at approximately 45° from top dead center and is adapted to receive run off preventing panel 18 when connecting member 12 is telescoped over a main tubular member 10**.

Slits **22*a* and 22*b* do not extend entirely through connecting member 12. Rather, there is a center portion 24 between aligned slit portions 22 of connecting member 12, so that center portion 24** of each connecting member, as measured in the axial direction thereof, is circumferentially unbroken.

A rectangular hanging panel 26 extends to the center portion 24 at one side at an approximately mid-horizontal plane thereof of connecting member 12, that is, 90° from top dead center and is formed integrally with connecting member 12 as a unitary member. Hanging panel 26 extends upwardly to the same height as hanging panel 14 when connecting member 12 is inserted over a tubular member 10, and includes hanging holes 28 therein for receiving nails (not shown) in order to secure hanging panel 28, and thereby, connecting member 12, to side 19 of the building, immediately below eaves 21 of roof 23. A rectangular run off preventing panel 30 extends at the opposite side of central portion of connecting member 12, at a position higher than that of hanging panel 26, at the aforementioned angle α and is formed integrally with connecting member 12 as a unitary member. Panel 30 is of the same height as panel 18 and positioned at the same angular location. Thus, when a tubular connecting member 12 is inserted over a main tubular member 10, hanging panels 14 and 26 abut against each other and effectively form a continuous hanging panel.

The abutting ends of hanging panels 14 and 26 can be adhered to each other by a suitable adhesive to provide a water seal thereat.

Figure 4:
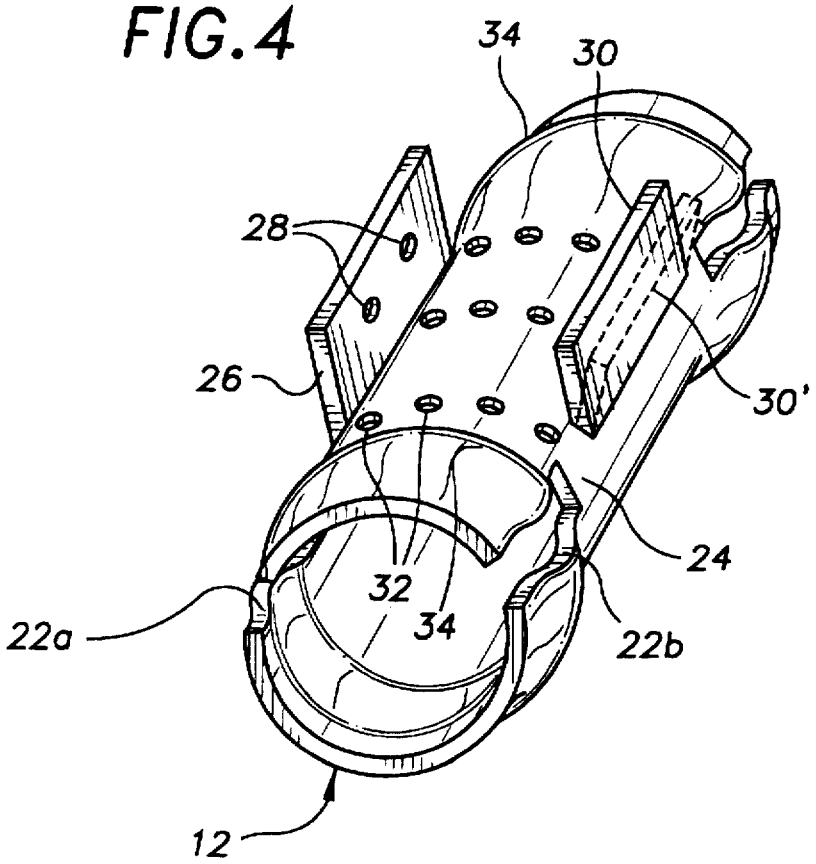
FIG. 4 is a perspective view of a tubular connecting member of the gutter system.
Figure 5:
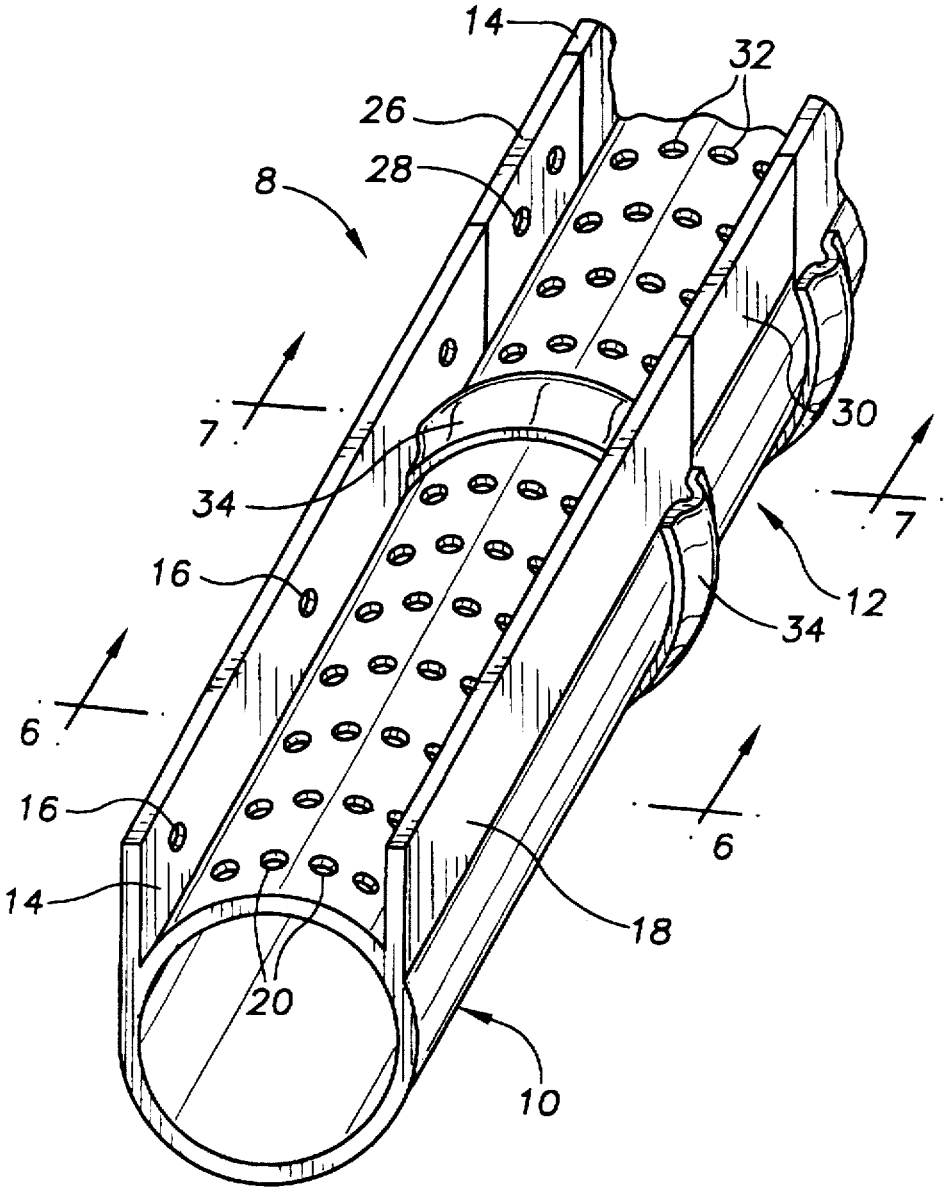
FIG. 5 is a perspective view of two elongated tubular members connected together by a tubular connecting member.
Figure 6:
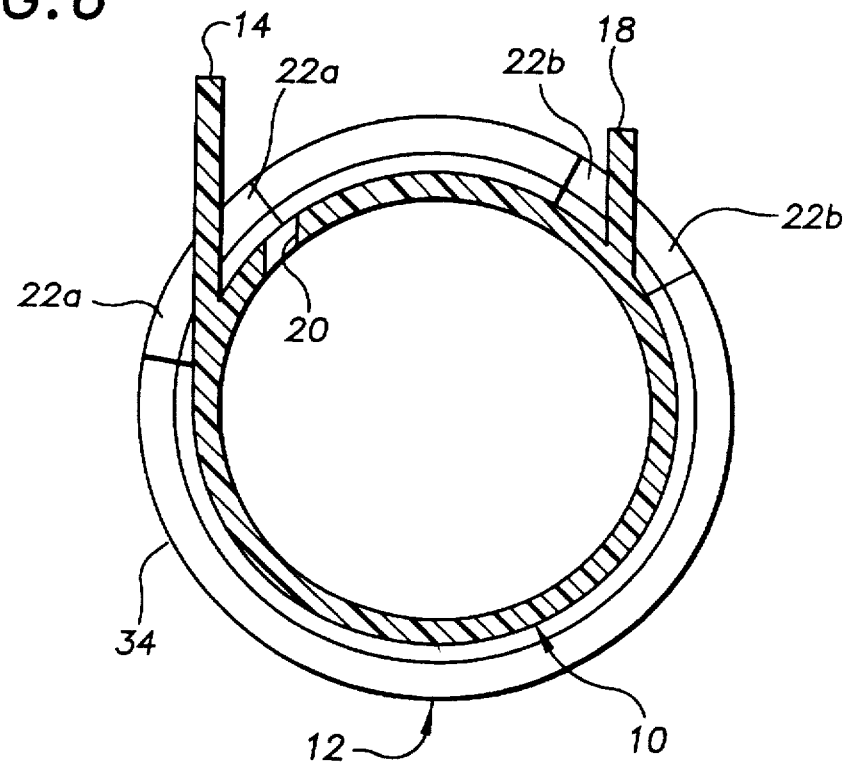
FIG. 6 is a cross-sectional view of FIG. 5, taken along line 6—6 thereof.
Figure 7:
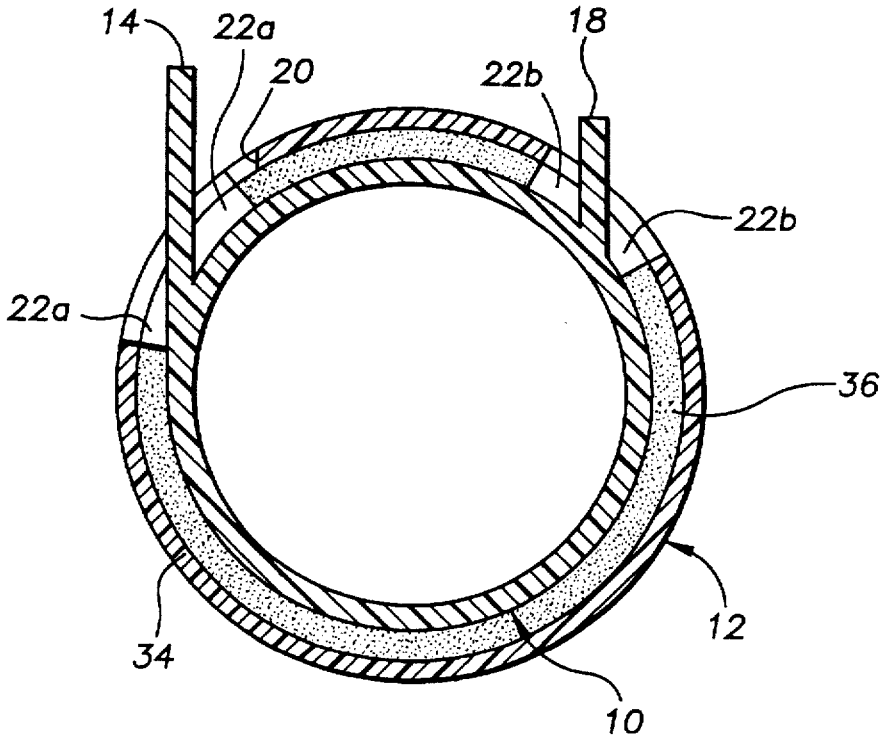
FIG. 7 is a cross-sectional view of FIG. 5, taken along line 7—7 thereof.

Alternatively, in a more preferred arrangement, as shown by dashed lines in FIG. 4, panel 30' extends outwardly from connecting member 12 in a radial direction, but still a little higher than the upper end of connecting member 12. With this arrangement, leaves that fall on the top of connecting member 12 can be easily blown out or washed off. However, panel 30' still functions to prevent run off of water.

In like manner, at such time, run off preventing panels 18 and 30 abut against each other and effectively form a continuous run off preventing panel. The abutting ends of run off preventing panels 18 and 30 can be adhered to each other by a suitable adhesive to provide a water seal thereat.

Further, a plurality of holes 32 are provided in the upper portion of connecting member 12 between panels 26 and 30, and are generally in the same orientation and spacing as holes 20 of tubular member 10. Because of panels 26 and 30, any water impinging upon the upper surface of tubular connecting member 12 is prevented from escaping, and must enter holes 32, where the water is drained off to another location, for example, to a downspout.

Thus, connecting members 12 can connect together a plurality of tubular members 10. In one embodiment, an adhesive is provided on the inner surfaces at the ends of connecting member 12 and on the outer surfaces at the ends of tubular members 10 prior to assembly of the same together. Thus, a permanent assembly is provided, and more importantly, leakage is provided.

In a preferred embodiment, the ends of tubular connecting members 12 have a U-shape in an axial cross-section, so as to define U-shaped circumferential channels 34 thereat. As a result, an adhesive 36 can be inserted within channels 34 after assembly of the entire gutter system 8, for example, by inserting adhesive 36 into the ends of channels 34 at the positions of slits **22*a* and 22*b*, that is, where channels 34 terminate immediately before the respective panels 14, 18, 26 and 30. Thus, the entire gutter system 8 can be assembled first before adhesively securing the same together. Specifically, when assembling gutter system 8, any slight offset at one end of side 19 of the building may turn into a larger offset at the opposite end of side 19 of the building. Therefore, any adjustment can be made in gutter system 10** prior to adhesively securing the same together.

Thus, with the present invention, because of the tubular construction with holes 20 and 32, leaves and other large debris are kept out of gutter system. Further, the unbroken tubular construction gives much greater strength to gutter system 8 over conventional U-shaped channel gutter systems, or even gutter systems having a lengthwise slit therein. Still further, the entire gutter system 8 can be assembled before adhesively securing the same together.

Figure 8:
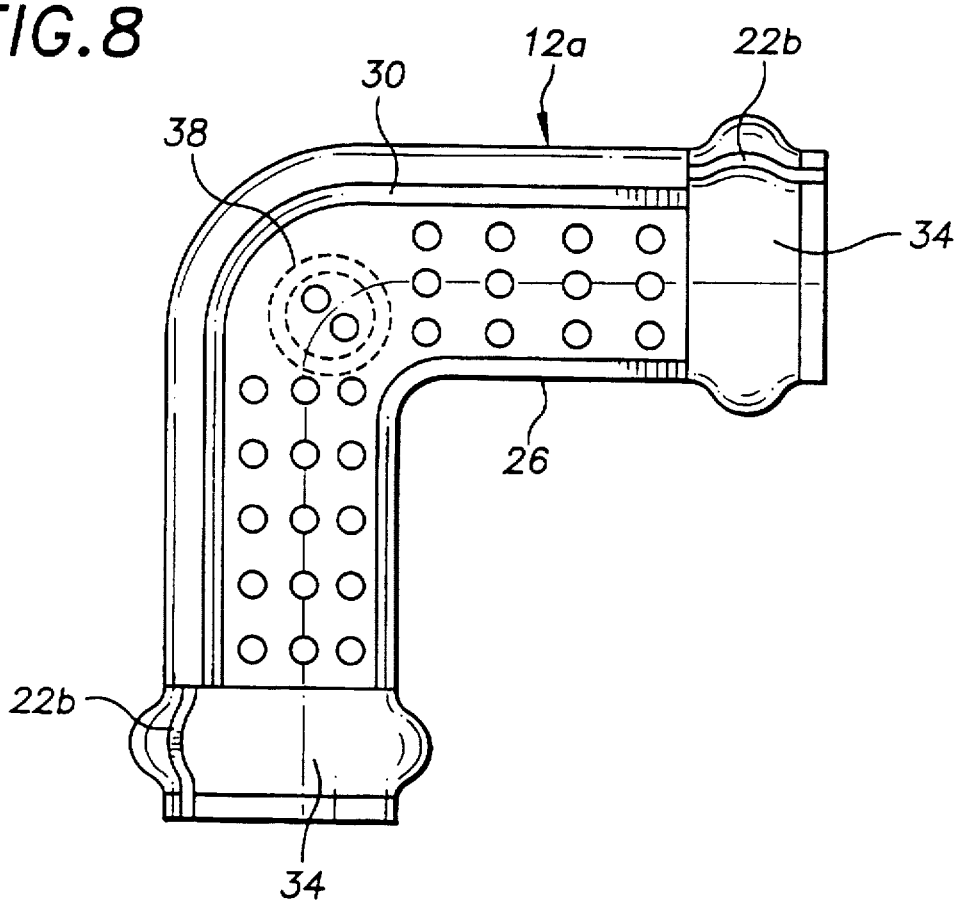
FIG. 8 is a top plan view of a tubular corner member of the gutter system, with a downspout.
Figure 9:
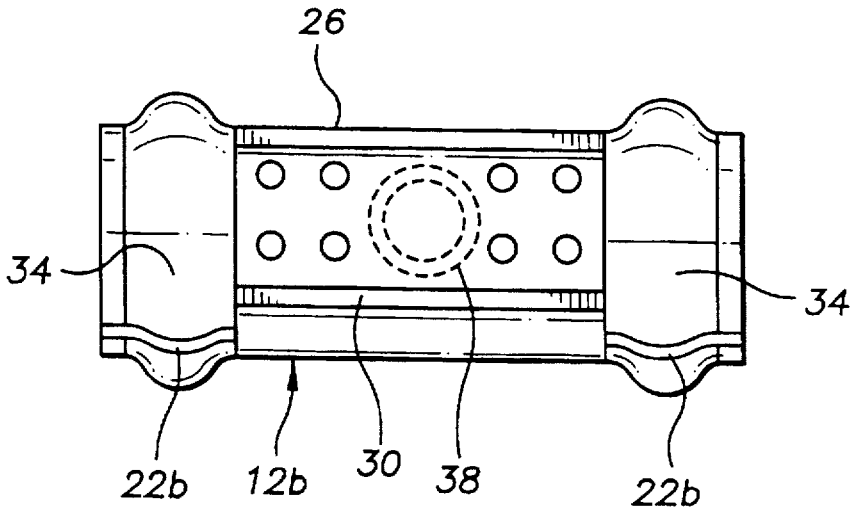
FIG. 9 is a top plan view of a tubular T-shaped member of the gutter system, with a downspout.

In addition to the above construction, variations in the shapes of main tubular members 10 and tubular connecting members 12 can also be provided. For example, as shown in FIG. 8, tubular connecting members **12*a* can be formed in an elbow shape for a corner of a building, and include a downspout connection 38. Alternatively, as shown in FIG. 9, tubular connector members 12*b* can be formed in a T-shape and include downspout connection 38. Any other suitable configurations can be provided, such as Y-shapes and the like. The U-shaped circumferential channels 34 are omitted in FIGS. 8 and 9** for the sake of clarity of the drawings.

Figure 11:
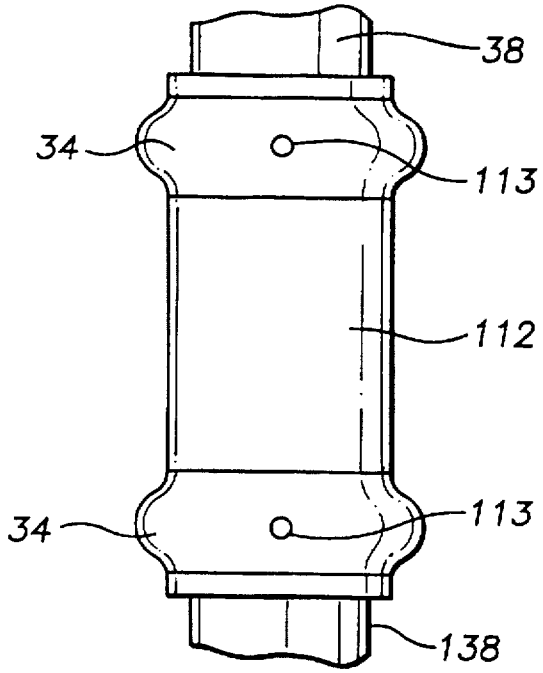
FIG. 11 is a side elevational view of another downspout connector.

In accordance with the present invention, as shown in FIG. 11, a tubular connector 112 is provided for connecting downspout connection 38 to a downspout 138. Tubular connector 112 is formed with U-shaped circumferential channels 34 at both ends thereof. Since there are no slits as with slits **22*a* and 22*b*, some means must be provided to access channels 34 once tubular connector 112 is connected to a downspout connection 38. In this regard, a small opening 113 can be provided in each channel 34**, which becomes sealed when the adhesive is provided therein after connection.

Figure 10:
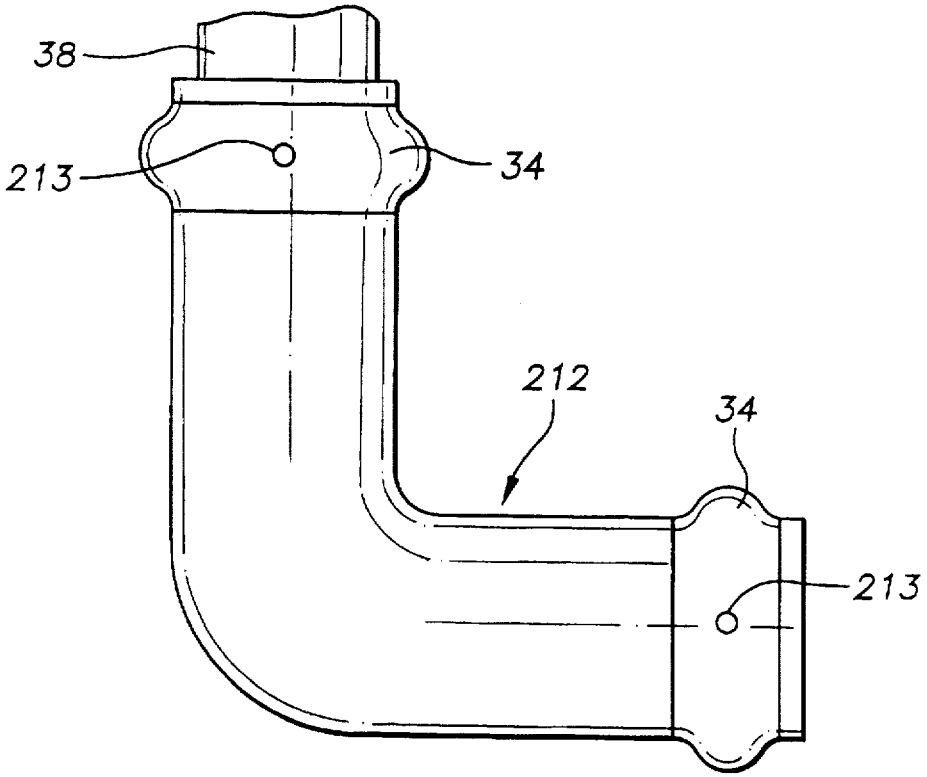
FIG. 10 is a side elevational view of a downspout connector.

In the event that it is desired to connect to redirect the water from a downspout connection 38, that is, to change the angle thereof, a tubular angled or elbow connector 212 can be provided which is formed with U-shaped circumferential channels 34 at both ends thereof. As with connector 112, a small opening 213 can be provided in each channel 34, which becomes sealed when the adhesive is provided therein after connection. This is shown in FIG. 10.

It will be appreciated that the elements shown and described herein are not to scale.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention as defined by the appended claims.

What is claimed is:

1. A gutter system comprising:

a plurality of main tubular members, each said main tubular member including:

a first tube extending in an axial direction, a first hanging panel extending substantially the entire length of said tube and formed to one side of said tube, for securing the tube to a building, a first run off preventing panel extending substantially the entire length of said tube and formed to an opposite side of said tube, for preventing run off of water from said tube, a plurality of first spaced apart holes in said tube in an area between said hanging panel and said run off preventing panel, such that said tube is substantially continuously unbroken except for said holes; and a plurality of tubular connecting members, each said tubular connecting member including:

a second tube having ends with an inner diameter equal to or greater than an outer diameter of ends of the first tubes of said main tubular members so as to receive said ends of the first tubes therein, said second tube extending in said axial direction and having a length much less than the lengths of said main tubular members, a second hanging panel extending in said axial direction and formed to one side of said second tube, for securing the second tube to the building, a second run off preventing panel extending in said axial direction and formed to an opposite side of said second tube, for preventing run off of water from said second tube, a plurality of second spaced apart holes in said second tube in an area between said second hanging panel and said second run off preventing panel, a first slit extending in said axial direction from opposite ends of said second tube and extending for a distance less than one-half the length of said second tube so as to define a central portion of said second tube which is not cut-away, each said first slit adapted to receive said first hanging panel when said tubular connecting member is inserted over an end of one said main tubular member, and a second slit extending in said axial direction from opposite ends of said second tube and on an opposite side of said second tube from said first slit, said second slit extending for a distance less than one-half the length of said second tube so as to define a central portion of said second tube which is not cut-away, each said second slit adapted to receive said first run off preventing panel when said tubular connecting member is inserted over an end of one said main tubular member.

2. A gutter system according to claim 1, wherein each said hanging panel includes at least one hole therein for securing the main tubular members and tubular connecting members to a building.

3. A gutter system according to claim 1, wherein said first and second hanging panels are formed on said first tube and second tube, respectively, at angular positions on said first and second tubes of approximately 90° from an upper end thereof.

4. A gutter system according to claim 1, wherein said first and second run off preventing panels are formed on said first tube and second tube, respectively, at angular positions on said first and second tubes of approximately 45° from an upper end thereof.

5. A gutter system according to claim 1, wherein said second hanging panel and said second run off preventing panel are formed on said central portion of said second tube.

6. A gutter system according to claim 1, wherein said second hanging panel and said second run off preventing panel extend in said axial direction for a length less than the length of said second tube.

7. A gutter system according to claim 1, wherein said first tubes of said main tubular members and said second tubes of said tubular connecting members are made from PVC pipe.

8. A gutter system according to claim 1, wherein at least one said tubular connecting member includes a downspout connection for connecting to a downspout.

9. A gutter system according to claim 8, further comprising a second tubular connecting member for connecting the downspout connection to a downspout, said second tubular connecting member including a tube having ends with an inner diameter equal to or greater than an outer diameter of a free end of the downspout connection and the downspout so as to receive said ends of the downspout connection and the downspout therein, said tube of said second connecting member being deformed at opposite ends thereof with outwardly bowed U-shaped circumferential channels for receiving an adhesive therein to secure said second tubular connecting member to said downspout connection and to the downspout.

10. A gutter system comprising:

a plurality of main tubular members, each said main tubular member including:

a first tube extending in an axial direction, a first hanging panel extending in said axial direction substantially the entire length of said tube and formed to one side of said tube, for securing the tube to a building, a first run off preventing panel extending in said axial direction substantially the entire length of said tube and formed to an opposite side of said tube, for preventing run off of water from said tube, a plurality of first spaced apart holes in said tube in an area between said hanging panel and said run off preventing panel; and a plurality of tubular connecting members, each said tubular connecting member including:

a second tube having ends with an inner diameter equal to or greater than an outer diameter of ends of the first tubes of said main tubular members so as to receive said ends of the first tubes therein, said second tube extending in said axial direction and having a length much less than the lengths of said main tubular members, said second tube being deformed at opposite ends thereof with outwardly bowed U-shaped circumferential channels for receiving an adhesive therein to secure said tubular connecting members to said main tubular members, a second hanging panel extending in said axial direction and formed to one side of said second tube, for securing the second tube to the building, a second run off preventing panel extending in said axial direction and formed to an opposite side of said second tube, for preventing run off of water from said second tube, a plurality of second spaced apart holes in said second tube in an area between said second hanging panel and said second run off preventing panel, a first slit extending in said axial direction from opposite ends of said second tube and extending for a distance less than one-half the length of said second tube so as to define a central portion of said second tube which is not cut-away, each said first slit adapted to receive said first hanging panel when said tubular connecting member is inserted over an end of one said main tubular member, and a second slit extending in said axial direction from opposite ends of said second tube and on an opposite side of said second tube from said first slit, said second slit extending for a distance less than one-half the length of said second tube so as to define a central portion of said second tube which is not cut-away, each said second slit adapted to receive said first run off preventing panel when said tubular connecting member is inserted over an end of one said main tubular member.

11. A gutter system according to claim 10, wherein said tube is substantially continuously unbroken except for said first holes therein.

12. A gutter system according to claim 10, wherein each said hanging panel includes at least one hole therein for securing the main tubular members and tubular connecting members to a building.

13. A gutter system according to claim 10, wherein said first and second hanging panels are formed on said first tube and second tube, respectively, at angular positions on said first and second tubes of approximately 90° from an upper end thereof.

14. A gutter system according to claim 10, wherein said first and second run off preventing panels are formed on said first tube and second tube, respectively, at angular positions on said first and second tubes of approximately 45° from an upper end thereof.

15. A gutter system according to claim 10, wherein said second hanging panel and said second run off preventing panel are formed on said central portion of said second tube.

16. A gutter system according to claim 10, wherein said second hanging panel and said second run off preventing panel extend in said axial direction for a length less than the length of said second tube.

17. A gutter system according to claim 10, wherein said first tubes of said main tubular members and said second tubes of said tubular connecting members are made from PVC pipe.

18. A gutter system according to claim 10, wherein at least one said tubular connecting member includes a downspout connection for connecting to a downspout.

19. A gutter system according to claim 10, further comprising a second tubular connecting member for connecting the downspout connection to a downspout, said second tubular connecting member including a tube having ends with an inner diameter equal to or greater than an outer diameter of a free end of the downspout connection and the downspout so as to receive said ends of the downspout connection and the downspout therein, said tube of said second connecting member being deformed at opposite ends thereof with outwardly bowed U-shaped circumferential channels for receiving an adhesive therein to secure said second tubular connecting member to said downspout connection and to the downspout.

20. A gutter system comprising:

a plurality of main tubular members, each said main tubular member including:

a first PVC tube extending in an axial direction, a first hanging panel extending in said axial direction substantially the entire length of said tube and formed to one side of said tube, said hanging panel including at least one hole therein for securing the main tubular member to a building, a first run off preventing panel extending in said axial direction substantially the entire length of said tube and formed to an opposite side of said tube, for preventing run off of water from said tube, a plurality of first spaced apart holes in said tube in an area between said hanging panel and said run off preventing panel such that said tube is substantially continuously unbroken except for said first holes therein; and a plurality of tubular connecting members, each said tubular connecting member including:

a second PVC tube having ends with an inner diameter equal to or greater than an outer diameter of ends of the first tubes of said main tubular members so as to receive said ends of the first tubes therein, said second tube extending in said axial direction and having a length much less than the lengths of said main tubular members, said second tube being deformed at opposite ends thereof with outwardly bowed U-shaped circumferential channels for receiving an adhesive therein to secure said tubular connecting members to said main tubular members, a second hanging panel extending in said axial direction for a length less than the length of said second tube and formed to one side of said second tube, said second hanging panel including at least one hole therein for securing the tubular connecting member to a building, a second run off preventing panel extending in said axial direction for a length less than the length of said second tube and formed to an opposite side of said second tube, for preventing run off of water from said second tube, a plurality of second spaced apart holes in said second tube in an area between said second hanging panel and said second run off preventing panel, a first slit extending in said axial direction from opposite ends of said second tube and extending for a distance less than one-half the length of said second tube so as to define a central portion of said second tube which is not cut-away, each said first slit adapted to receive said first hanging panel when said tubular connecting member is inserted over an end of one said main tubular member, and a second slit extending in said axial direction from opposite ends of said second tube and on an opposite side of said second tube from said first slit, said second slit extending for a distance less than one-half the length of said second tube so as to define a central portion of said second tube which is not cut-away, each said second slit adapted to receive said first run off preventing panel when said tubular connecting member is inserted over an end of one said main tubular member.

21. A gutter system according to claim 20, wherein said first and second hanging panels are formed on said first tube and second tube, respectively, at angular positions on said first and second tubes of approximately 90° from an upper end thereof.

22. A gutter system according to claim 20, wherein said first and second run off preventing panels are formed on said first tube and second tube, respectively, at angular positions on said first and second tubes of approximately 45° from an upper end thereof.

* * * * *